United States Patent [19]

Giordano

[11] 4,176,859

[45] Dec. 4, 1979

[54] NON-COUNTERFEITABLE DOCUMENTS

[75] Inventor: Dennis R. Giordano, Cheektowaga, N.Y.

[73] Assignee: Safron Printing Company, Detroit, Mich.

[21] Appl. No.: 905,578

[22] Filed: May 15, 1978

[51] Int. Cl.[2] ..... B42D 15/00

[52] U.S. Cl. ..... 283/8 R; 283/6; 427/7; 428/916

[58] Field of Search ..... 283/6, 7, 8 R; 427/7; 428/916

[56] References Cited

U.S. PATENT DOCUMENTS

| | | | |
|---|---|---|---|
| 3,414,998 | 12/1968 | Berger | 283/6 X |
| 3,852,088 | 12/1974 | Godlewski et al. | 283/8 R |
| 4,095,824 | 6/1978 | Bachman | 283/6 |
| 4,118,122 | 10/1978 | Rees et al. | 283/6 X |

*Primary Examiner*—Robert L. Spicer, Jr.

*Attorney, Agent, or Firm*—Michael G. Berkman

[57] ABSTRACT

An invalidating marking appears on photoreproductions of security documents such as checks, bonds, stock certificates, lottery tickets, and currency. The invalidating marking is disguised on the original by use of disguising markings and printing the invalidating mark and the background with different line screen frequencies.

5 Claims, No Drawings

NON-COUNTERFEITABLE DOCUMENTS

BACKGROUND OF THE INVENTION

1. Field of Invention

There is a widespread need for security papers which cannot be counterfeited by photocopy methods. Banking institutions, security firms, and government agencies are alarmed by the capability of present-day copiers such as the Xerox 6500 Color Copier to make faithful color reproductions of bank drafts, stocks and bonds, currency, and the like. As a specific example, dollar bills have been copied and the copies successfully used in bill changers. Commercial printers of checks are actively searching for methods of producing acceptably attractive checks which cannot be faithfully reproduced by color copiers and any reproduction is readily discernible as a counterfeit.

2. Prior Art

Several approaches have been used to prevent the reproduction of documents. Godlewski et al., U.S. Pat. No. 3,852,088 uses a special ink for printing on indicia which does not copy well in the Xerox 2400 or the IBM Copier. This depends on the novel combination of the ink and background color of the document. Braun, U.S. Pat. No. 3,831,007 describes documents which are made non-reproducible through the use of groups of parallel lines combined with other groups of parallel lines, which groups are not parallel to each other. The spacings between the lines are such that the sensors in the photocopiers will not operate to give faithful reproduction of the lined original. Ludlow Paper Co., Needham, Mass., has manufactured a paper called Copy-Trol which is claimed to be copy-proof. The paper is deep cocoa in color. Fitchburg Paper Co., Fitchburg, Mass., has also manufactured a similar type paper which they sell under the name of "No Copy" paper. These processes result in products which are not readily accepted by the banking and securities industries. The esthetics of the products are not attractive due to color, distracting lines and other markings, lack of clarity in printing etc.

Since the lens of the Xerox 6500 will copy and reproduce a screen of 100 lines per inch, but will not produce a screen of 200 lines per inch, Xerox recommends using two different screen frequencies in the background of a document. The word "Void" is screened at 100 lines and the balance of the background at 200 lines. When the document is copied, the 200 line screen will drop out and leave only the word "Void" in the background of the copied document. Two problems result from this method. The word "Void" is noticeable on the document due to the different frequency screens. This is objectionable to the banks and may also result in the original being considered fraudulent. The second problem is the difficulty of producing and holding a good quality 200 line screen on rotary wet offset or litho presses.

It would be desirable to produce documents, which are esthetically attractive, without lines or other matter distracting from the message on the document. It is further desirable to not have the invalidating code appear on the original document. A further desired property is the direct appearance of an invalidating code such as "Void" clearly discernible on a fraudulent copy.

SUMMARY OF THE INVENTION

According to the invention, these objectives are achieved by producing an original document which, in appearance, is indistinguishable from the security forms now used, but which is characterized in that copies differ considerably from the original by showing a clearly discernible invalidating mark such as the word "Void."

A first step of the method of the invention is forming a composite negative which is used in preparing the printing plate. A first negative is imprinted with two different screen frequencies, one for invalidating the document copy and a second as a background pattern. A second negative containing a camouflage pattern is superimposed over the first negative. This composite is then used to create the final background negative from which an offset plate can be made. A wide range of standard colors can be used to print the background of the document, and the invalidating code such as "Void" is plainly discernible only on the photocopy of the original.

THE PREFERRED EMBODIMENT

The negative used in producing the final offset printing plate was made from a composite of negatives. A first negative was prepared in which the word "Void," "copy," etc., was screened at 85 lines per inch, (range of 85 to 100 lines per inch is suitable). The screen value or size of the dot can be varied from 20 to 40 percent. Preferably, the letters of "Void," etc. should be staggered to make the camouflage more effective. A background was then screened at 133 lines per inch. (Screen values from 130 to 150 lines per inch are suitable, but always at higher frequency than used for the word "Void"). Then a second negative was prepared containing a camouflage pattern consisting of blotches or shapes having no set pattern but creating definite line openings running through the entire background. A pattern which simulates parchment is quite satisfactory. This second negative containing the camouflage pattern was superimposed on the first negative containing the two frequency screens and the word "Void," etc. A final background negative was produced in which the word "Void" is completely comouflaged. This order of processing is important successfully to camouflage the word "Void," etc. The composite negative was used to make the background offset printing plate. The final documents, which may be printed by conventional techniques, for example, by rotary offset, cannot be photocopied without the invalidating legend "Void" being clearly reproduced.

The following illustrative examples show suitable screen frequencies, screen ratios, screen values or dot sizes, and colors for the camouflage background. Checks were printed and copies were made on the Xerox 6500 Color Copier, the Xerox 3100 LDC black and white copier, and the IBM Copier II in which the word "Void", was essentially indiscernible on the original check, but was clearly legible on photocopies. T,0060

What is claimed is:

1. A process for preventing the counterfeiting of documents through use of office copiers, and comprising preprinting an original document with background which includes an invalidating mark, said mark being effectively camouflaged in the original document as viewed visually but being clearly discernible in xerographic and photocopies made from the original document, said process including the steps of:

imprinting on said original document a background having two different indicia at two different screen frequencies, said indicia comprising an invalidating legend printed at a first screen frequency in the range of from about 85 to about 100 lines per inch, and a background pattern printed at a second screen frequency.

said second screen frequency being higher than said first screen frequency and in the range of from about 130 to about 150 lines per inch, to provide a composite camouflage background, imprinting a camouflaging pattern on said document, and overprinting on said background to provide a final document containing selectable information.

2. The process as set forth in claim 1 wherein an offset printing technique is used employing a plurality of negatives, said process including preparing a first negative depicting an invalidating mark and a background, said invalidating mark being screened at a frequency in the range of from about 85 to about 100 lines per inch, and said background being screened at a frequency from about 130 to about 150 lines per inch, preparing a second negative having no set pattern and serving as a mask for said invalidating mark, and superimposing said first and said second negatives to provide a background negative in which the invalidating mark is effectively camouflaged, preparing a background offset printing plate from said background negatives, and printing selectable document indicia and messages on a background defined by said background offset plate, to provide a final document.

3. The process as set forth in claim 1 wherein dots produced through said screening include dots varying in size from about 20% to about 40% in particular embodiments of the invention.

4. The process as set forth in claim 1 wherein said invalidating legend includes letters which are staggered to facilitate camouflaging thereof.

5. The process as set forth in claim 1 wherein said invalidating legend is imprinted at a screen frequency of 85 lines per inch and said background pattern is imprinted at a screen frequency of 133 lines per inch.

* * * * *

UNITED STATES PATENT OFFICE

CERTIFICATE OF CORRECTION

Patent No. 4,176,859 Dated December 4, 1979

Inventor(s) DENNIS R. GIORDANO

It is certified that error appears in the above-identified patent and that said Letters Patent are hereby corrected as shown below:

The assignee's name should appear as

SAFRAN PRINTING COMPANY.

Signed and Sealed this

*Twenty-second* Day of *April 1980*

[SEAL]

*Attest:*

SIDNEY A. DIAMOND

*Attesting Officer* *Commissioner of Patents and Trademarks*